US006026580A

United States Patent [19]

LaRue

[11] Patent Number: 6,026,580

[45] Date of Patent: Feb. 22, 2000

[54] AIMING SIGHT MOUNT

[76] Inventor: Mark C. LaRue, 14800 Brown Bluff Cir., Leander, Tex. 78641

[21] Appl. No.: 09/012,834

[22] Filed: Jan. 23, 1998

Related U.S. Application Data

[60] Provisional application No. 60/034,078, Jan. 24, 1997.

[51] Int. Cl.[7] ..... F41G 1/38

[52] U.S. Cl. ..... 33/250; 42/101

[58] Field of Search ..... 42/101; 33/250

[56] References Cited

U.S. PATENT DOCUMENTS

| | | | |
|---|---|---|---|
| 3,877,166 | 4/1975 | Ward | 42/1 |
| 3,880,389 | 4/1975 | Burris | 248/205 |
| 4,205,473 | 6/1980 | Wilson | 42/1 |
| 4,216,600 | 8/1980 | Brueckner et al. | 42/1 |
| 4,310,980 | 1/1982 | Pilkington | 42/1 |
| 4,353,180 | 10/1982 | Wilson | 42/1 |
| 4,446,644 | 5/1984 | Jimenez | 42/1 |
| 4,562,658 | 1/1986 | Govett | 42/1 |
| 4,756,111 | 7/1988 | Lapier | 42/101 |
| 4,799,325 | 1/1989 | Booze | 42/100 |
| 4,862,624 | 9/1989 | Williams | 42/101 |
| 5,144,752 | 9/1992 | Boeke et al. | 33/247 |
| 5,315,781 | 5/1994 | Beisner | 42/101 |
| 5,353,539 | 10/1994 | Zeh | 42/101 |

*Primary Examiner*—Charles T. Jordan
*Assistant Examiner*—Denise J Buckley
*Attorney, Agent, or Firm*—James J. Leary; Patrick T. Reilly; Carol D. Titus

[57] ABSTRACT

A gun sight mount is provided that enables the accurate and secure positioning of an optical sighting device onto a weapon or other equipment. The mount includes a base and a front and rear ring assemblies. The base is attached at at least two points to the weapon or equipment. The separate front and rear ring assemblies capture the weapon or equipment. The ring assemblies are secured to the base, whereby a secure mounting is acheived.

7 Claims, 9 Drawing Sheets

AIMING SIGHT MOUNT

CROSS REFERENCE TO OTHER APPLICATIONS

The application claims the benefit of U.S. Provisional Patent Application No. 60/034,078 filed Jan. 24, 1997.

FIELD OF INVENTION

The present invention relates to the design and implementation of devices used to mount and secure telescopic and laser sights to firearms, measuring systems, parametric data collection systems, navigation systems, locating systems and other direction orientable equipment.

BACKGROUND OF INVENTION

The development of reliable and convenient devices for mounting telescopic, laser and other sights onto firearms and various scientific and military equipment is of interest to a wide section of the public. A great deal of attention has been paid in particular to the mounting of telescopic sights onto firearms. The invention of Lapier et al., U.S. Pat. No. 4,756,111, is offered as being representative of general trends found in the prior art.

Much of the conventional art in the field of telescopic mounts has clearly been driven in view of a need for simplicity in device design, as made explicit in both Zeh, U.S. Pat. No. 5,353,539, and in Williams, U.S. Pat. No. 4,862,624.

Commercially available telescopic sight mounts are often frustrating to install for a novice weapons user. It is not unusual for a weapons user to actually damage a telescopic sight by undisciplined manipulation of the sight itself during installation onto a weapon.

Police force, military personnel and numerous civilian and scientific agencies view improvements in the convenience, ease and speed of the installation of reliable and accurate telescopic or directional mounts onto firearms and measuring or beam generating equipment to be of significant value.

Furthermore, devices used to mount telescopic sights onto weapons are often especially adaptable to wider applications in the areas of scientific, medical, police and military equipment.

SUMMARY OF THE INVENTION

It is an object of the present invention to provide a device that mounts a sighting mechanism onto direction specific equipment. In keeping with this objective, the present invention provides a rear assembly and a front assembly.

The rear assembly comprises a rear base and a rear assembly ring. The rear base is attached to a direction specific equipment, and the rear assembly ring secures a sight. The rear assembly ring is detachable from the rear base. The rear assembly ring splits into two parts that are used to capture the body of the sight. The two parts of the rear assembly ring are attached together around the sight.

The front assembly comprises a front base and a front assembly ring. The front base is attached to the direction specific equipment, and the front assembly ring secures the sight. The front assembly ring is detachable from the front base. The front assembly ring splits into two parts that are used to capture and secure the body of the sight. The two parts of the rear assembly ring are attached together around the sight.

The rear and front assembly rings are respectively inserted into the rear and front bases. In certain preferred embodiments of the present invention set screws are used to rigidly secure the rear and assembly rings to the rear and front bases.

In alternate preferred embodiments of the present invention the rear and front assembly rings are of identical manufacture. This design feature, when implemented, reduces the costs of manufacture, distribution and maintenance.

In alternate preferred embodiments of the present invention the entire rear and front assemblies are of identical manufacture. The costs of manufacture, distribution and maintenance are thus even further reduced in those preferred embodiments wherein this design feature implemented.

Certain alternate preferred embodiments of the present invention comprise a single unified base wherein all of the key features of the rear and front bases are included and provided.

The preferred embodiment is constructed of stainless steel, plastic, metal or metal alloy, or other suitable material known in the art.

DETAILED DESCRIPTION OF THE INVENTION

Figure 1:
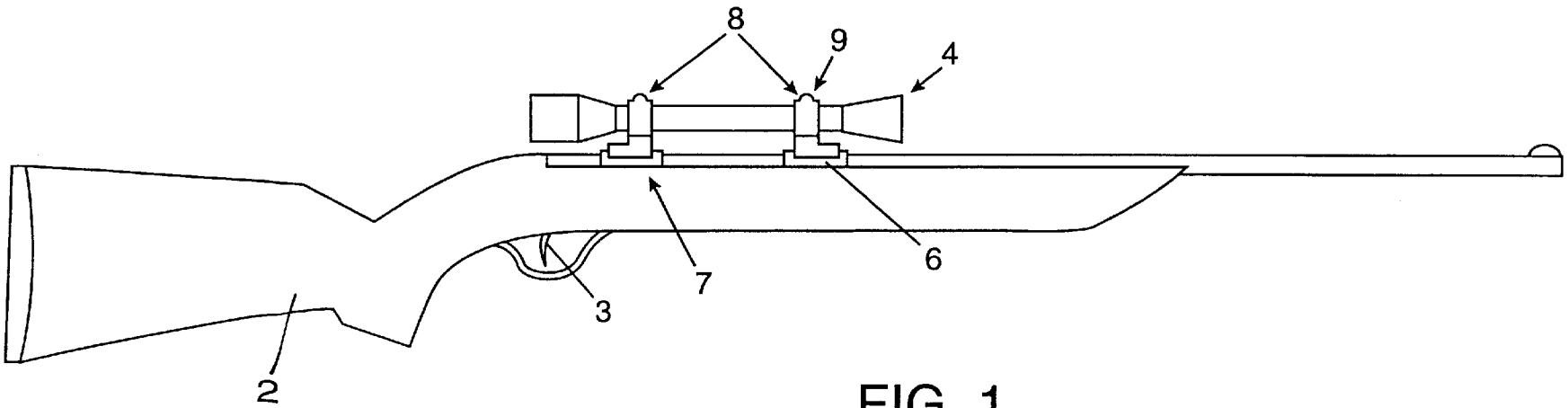
FIG. 1 illustrates a preferred embodiment of the present invention installed onto a receiver of a rifle and securing a telescopic site.

FIG. 1 illustrates a preferred embodiment of the present invention 8 installed onto the receiver 6 of a rifle 2 and securing a telescopic site 4. The preferred embodiment of FIGS. 1 through 7 includes a rear assembly 7 and a front assembly 9. The rear assembly 7 is mounted onto the receiver 6 closer to the trigger 3, and the front assembly 9 is mounted further away from trigger 3. As shown in the Figures, the rear assembly comprises a rear base 80 and a rear assembly ring 10. The front assembly 9 includes a front base 100 and a front ring assembly 40.

Figure 2A:
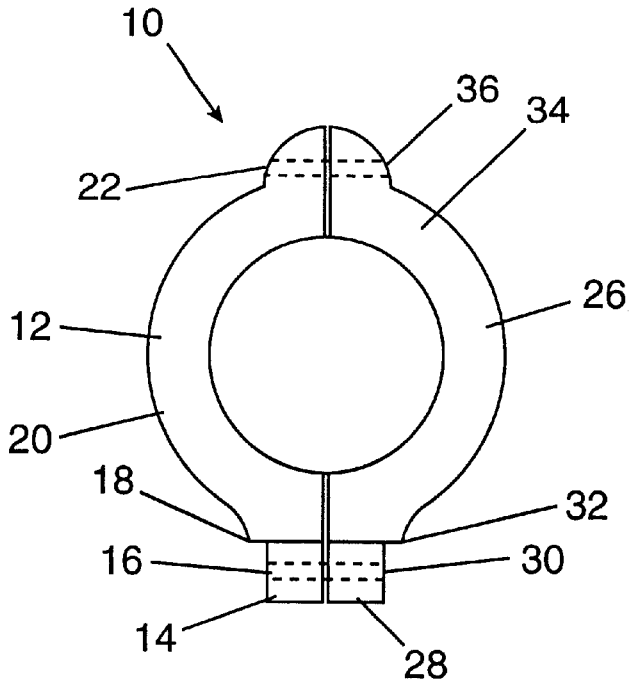
FIGS. 2A and 2B depicts individual front views of a preferred embodiment of a rear assembly ring and a front assembly ring of the preferred embodiment of FIG. 1.

FIG. 2A depicts a front view of a preferred embodiment of a rear assembly ring 10 of the preferred embodiment of FIG. 1. The rear assembly ring 10 comprises a first side 12 and a second side 26.

The first side 12 of the rear assembly ring 10 comprises a body 20, a tongue 14, a set screw hole 16, a ledge 18, and a top tapped hole 22.

The second side 26 of the rear assembly ring 10 comprises a body 34, a tongue 28, a tapped hole 30, a ledge 32, and a top tapped hole 36.

Figure 2B:
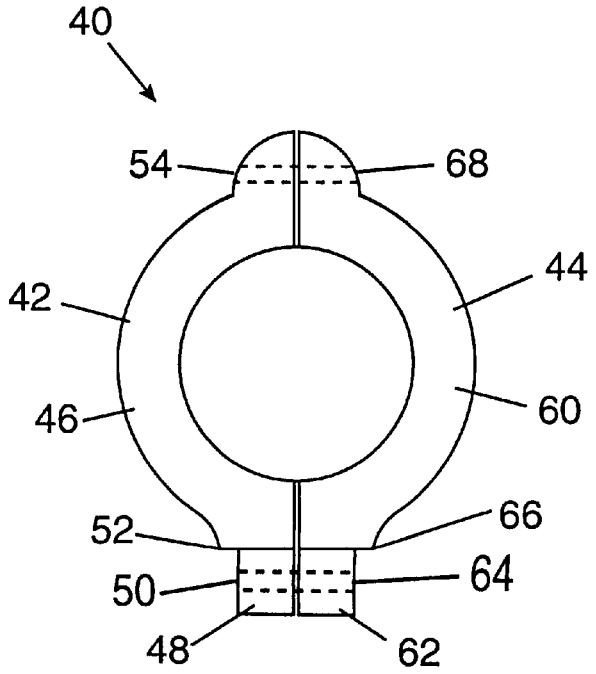

FIG. 2B depicts a front view of a front assembly ring 40 of the preferred embodiment of FIG. 1. The front assembly ring 40 comprises a third side 42 and a fourth side 44.

The third side 42 of the front assembly ring 40 comprises a body 46, a tongue 48, a set screw hole 50, a ledge 52, and a top tapped hole 54.

The fourth side 44 of front assembly ring 40 comprises a body 60, a tongue 62, a tapped hole 64, a ledge 66, and a top tapped hole 68.

Figure 3A:
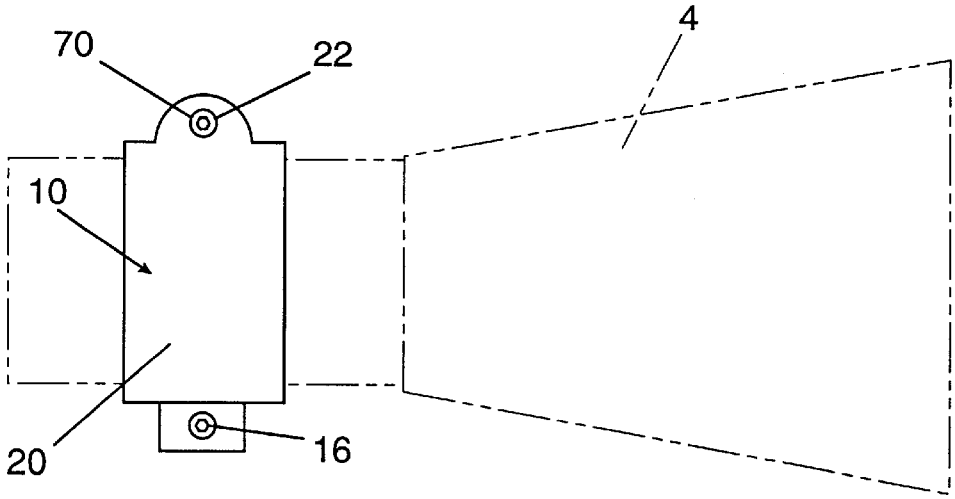
FIGS. 3A and 3B disclose two sides views of the rear assembly ring of the preferred embodiment of FIG. 1 attached to the telescopic sight and unattached to a rear base.
Figure 3B:
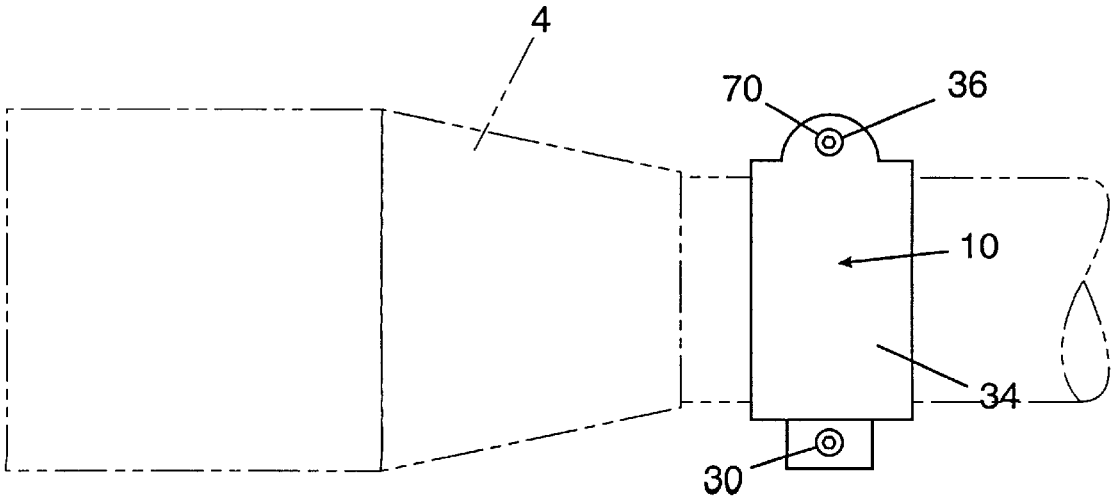

FIGS. 3A and 3B disclose two sides views of the rear assembly ring 10 of FIG. 2A attached to a telescopic sight and unattached to a rear base. The top tapped holes 22 and 36 are attached together by means of a screw 70. The body 20 of the first side 12 and the body 34 of the second side 26 fit snugly around the telescopic sight 4.

Figure 4A:
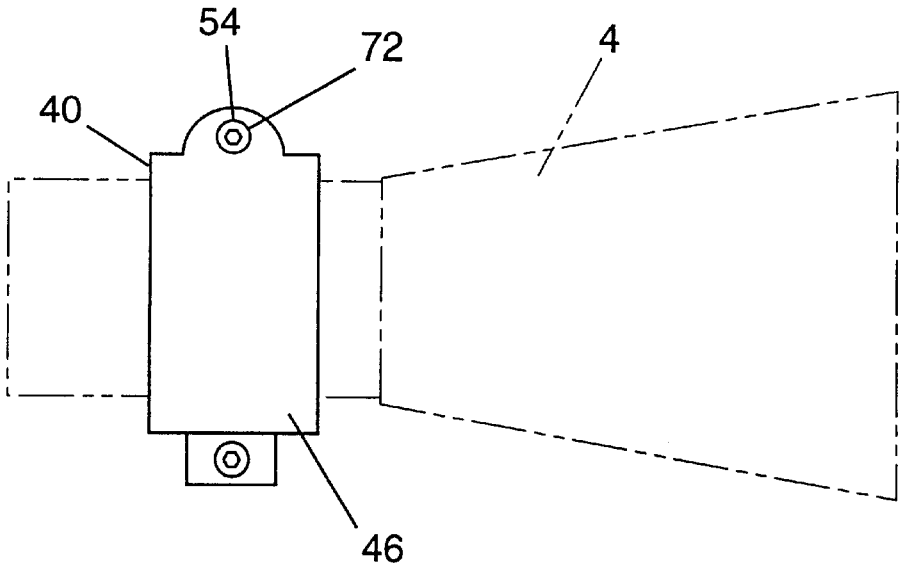
FIGS. 4A and 4B present two sides views of the front assembly ring of the preferred embodiment of FIG. 1 attached to the telescopic sight and unattached to a front base.
Figure 4B:
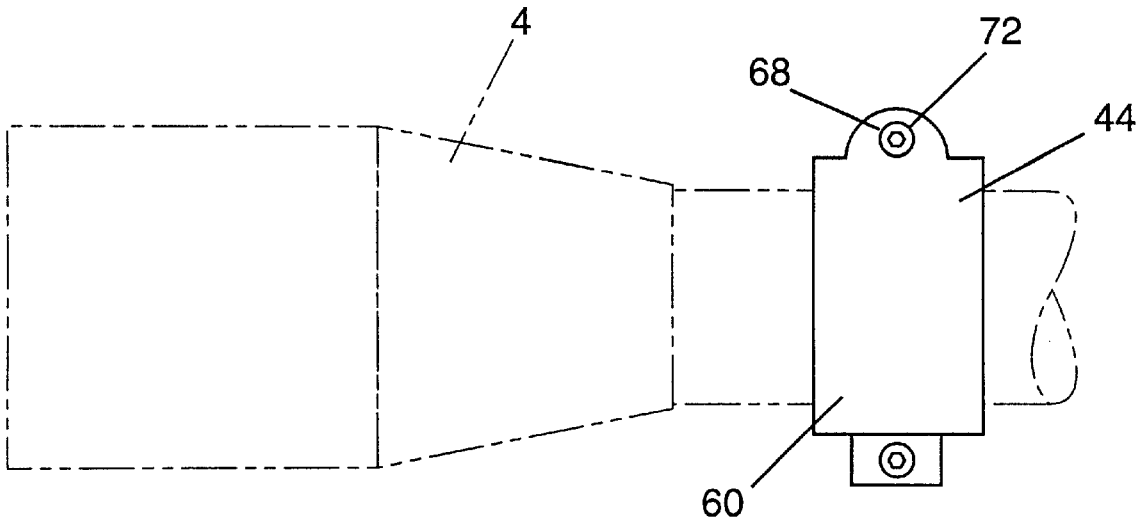

FIGS. 4A and 4B present two sides views of the front assembly ring 40 of FIG. 2B attached to the telescopic sight 4 and unattached to a front base. The top tapped holes 54 and 68 are attached together by means of a screw 72. The body 46 of the third side 42 and the body 60 of the fourth side 44 fit snugly around telescopic sight 4.

Figure 5A:
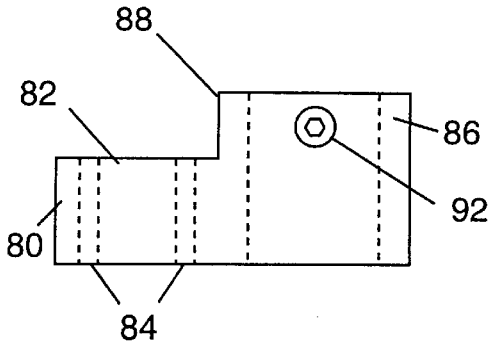
FIGS. 5A and 5B illustrate two side views of the rear base of the preferred embodiment of FIG. 1.
Figure 5B:
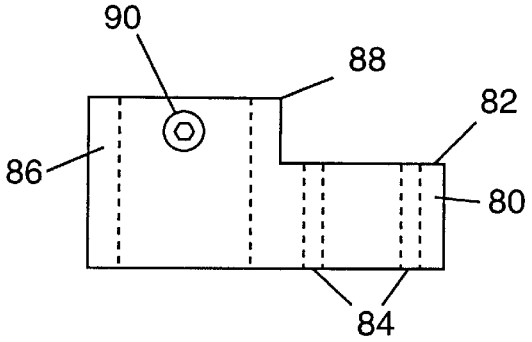

FIGS. 5A and 5B illustrate two side views of the rear base 80. The rear base 80 comprises a body 82, threaded holes 84, a bushing 86, a shoulder 88, a thru hole 90 and a threaded set screw hole 92.

Threaded holes 84 are used to attach rear base 80 to the rifle receiver 6. The bushing 86 accepts the rear assembly ring tongues 14 and 28. The shoulder 88 presents a reliable support plane for the ledges 18 and 32 of the rear assembly ring 10.

The shoulder 88, the thru hole 90 and the threaded set screw hole 92 are used to repeatably, reliably and rigidly maintain the desired orientation of the rear assembly ring 10 when the rear assembly ring 10 is mounted into the rear base 80.

Figure 6A:
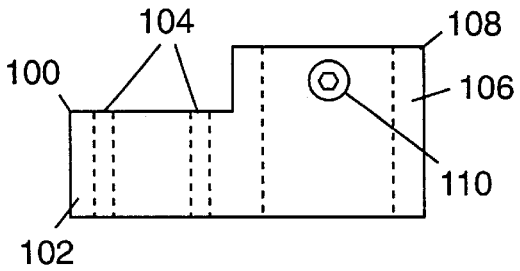
FIGS. 6A and 6B depict two side views of the front base of the preferred embodiment of FIG. 1.
Figure 6B:
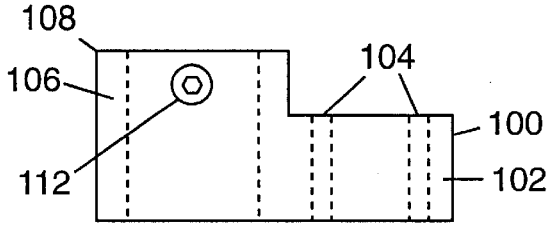

FIGS. 6A and 6B illustrate two side views of a front base 100. The front base 100 comprises a body 102, threaded holes 104, a bushing 106, a shoulder 108, a thru hole 110 and a threaded set screw hole 112.

The threaded holes 104 are used to attach the front base 100 to the rifle receiver 6. The bushing 106 accepts the rear assembly ring tongues 48 and 62 of the front assembly ring 40. The shoulder 108 presents a reliable support plane for the ledges 52 and 66 of front assembly ring 40.

The shoulder 108, the threaded hole 110 and the threaded set screw hole 112 are used to repeatably, reliably and rigidly maintain the desired orientation of the front assembly ring 40 when the front assembly ring 40 is properly mounted into the front base 100.

Figure 7A:
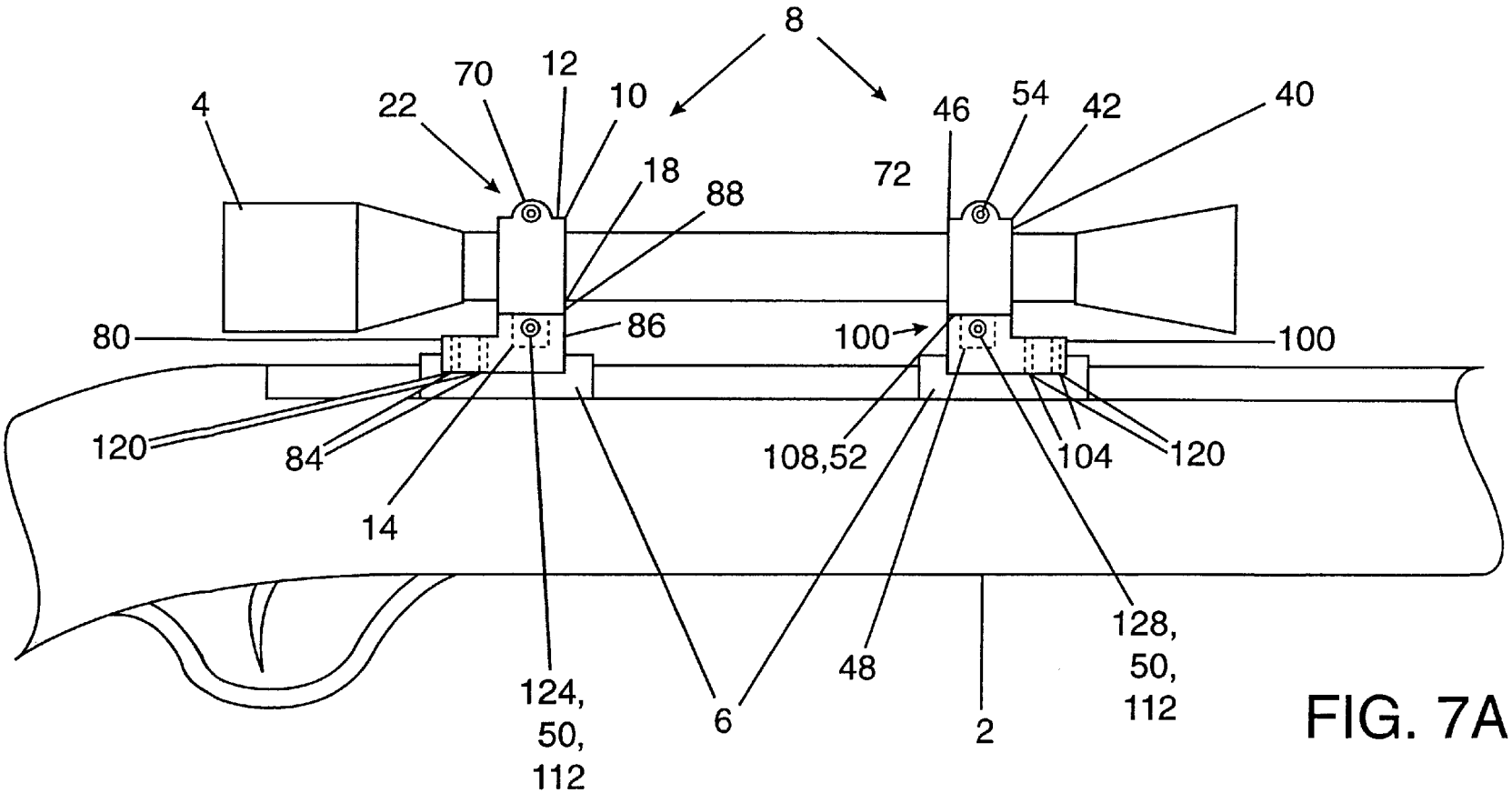
FIG. 7 is a detailed illustration of the preferred embodiment of the present invention of FIG. 1 installed onto the receiver of the rifle and securing the telescopic site.
Figure 7B:
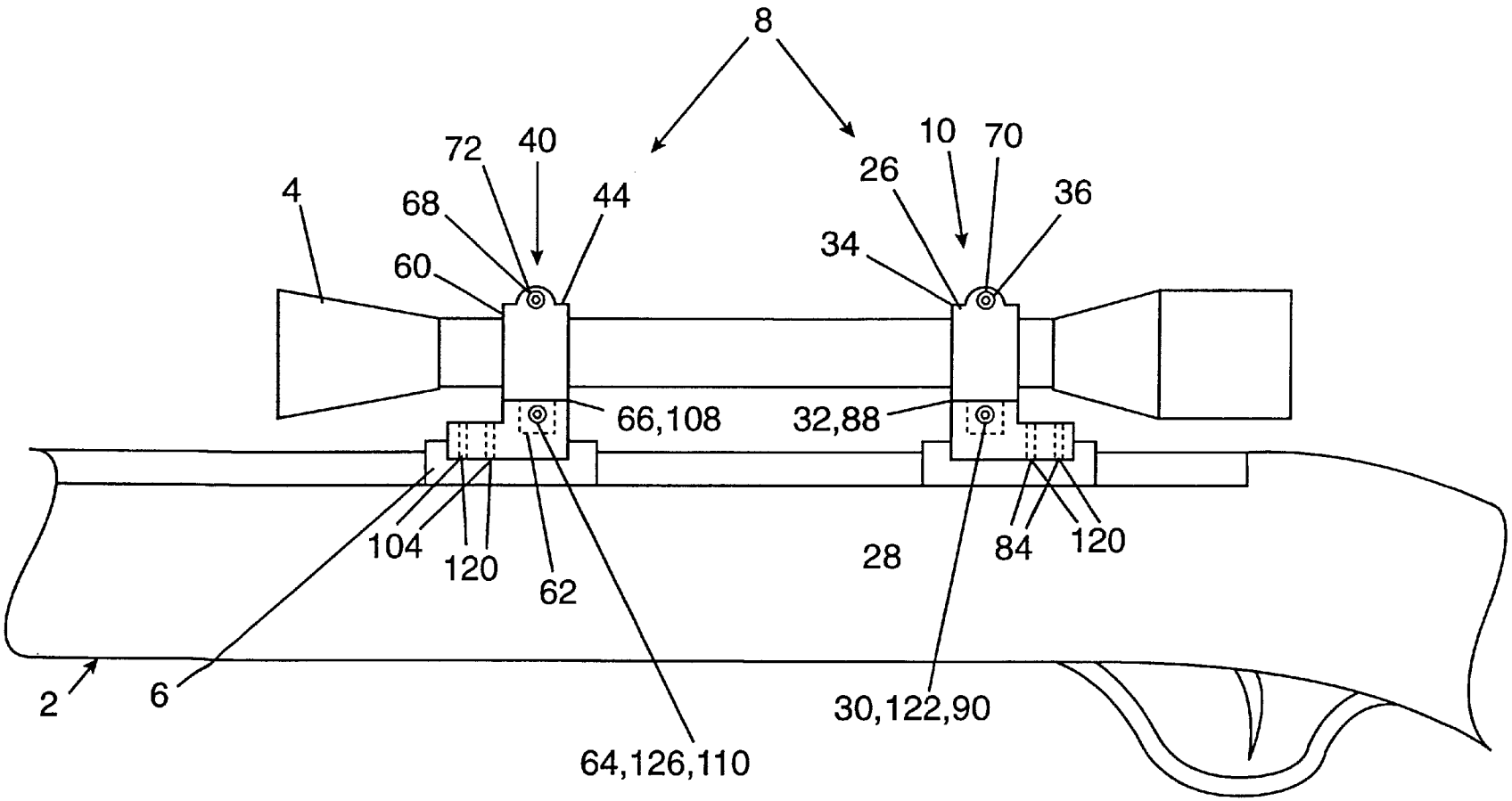

FIGS. 7A and 7B are detailed side views of a preferred embodiment of the present invention 8 installed onto the receiver 6 of the rifle 2 and securing the telescopic site 4. The attachment screws 120 thread directly through threaded holes 84 and 108, and thereby mount and secure the rear and front bases 80 and 100 to the receiver 6.

Tongues 14 and 28 of the rear assembly ring 10 are inserted into the bushing 86. The ledges 18 and 32 of the rear assembly ring 10 are resting against the shoulder 88 of the rear base 80.

Attachment screw 122 secures the second side 26 of the rear assembly ring 10 to the rear base 80 by threading through the thru hole 90 and into the tapped hole 30 of the second side 26. Furthermore, set screw 124 is threaded into the threaded set screw hole 92 of rear base 80 and fully towards the set screw hole 16 of the first side 12 of the rear assembly ring 10.

The additional pressure applied by the set screw 124 against the first side 12 increases the ruggedness and effectiveness of the present invention 8. In certain alternate preferred embodiments of the present invention the set screw hole 16 of the first side 12 is intentionally located slightly off center from set screw hole 92 so as to cause a slight jamming between set screw 124 and first side 12.

The first and second sides 12 and 22 fit snugly around the telescopic sight 4 and are secured together by the attachment screw 70, and as described above in reference to FIGS. 3A and 3B.

The tongues 48 and 62 of the front assembly ring 40 are inserted into the bushing 106. The ledges 52 and 66 of the front assembly ring 40 are resting against shoulder 108 of front base 100.

An attachment screw 126 secures the fourth side 44 of the front assembly ring 40 to the front base 100 by threading through the thru hole 110 and into the tapped hole 64 of the fourth side 44. Furthermore, a set screw 128 is threaded into the threaded set screw hole 112 of the front base 100 and fully towards the set screw hole 50 of the third side 42 of the front assembly ring 40.

The additional pressure applied by the set screw 128 against the third side 42 increases the ruggedness and effectiveness of the present invention 8. In certain alternate preferred embodiments of the present invention set screw hole 50 is intentionally located slightly off center from the threaded set screw hole 112 so as to cause a slight jamming between the set screw 128 and the third side 42.

The third and fourth sides 42 and 44 fit snugly around the telescopic sight 4 and are secured together by the attachment screw 72, and as described above in reference to FIGS. 4A and 4B.

Figure 8:
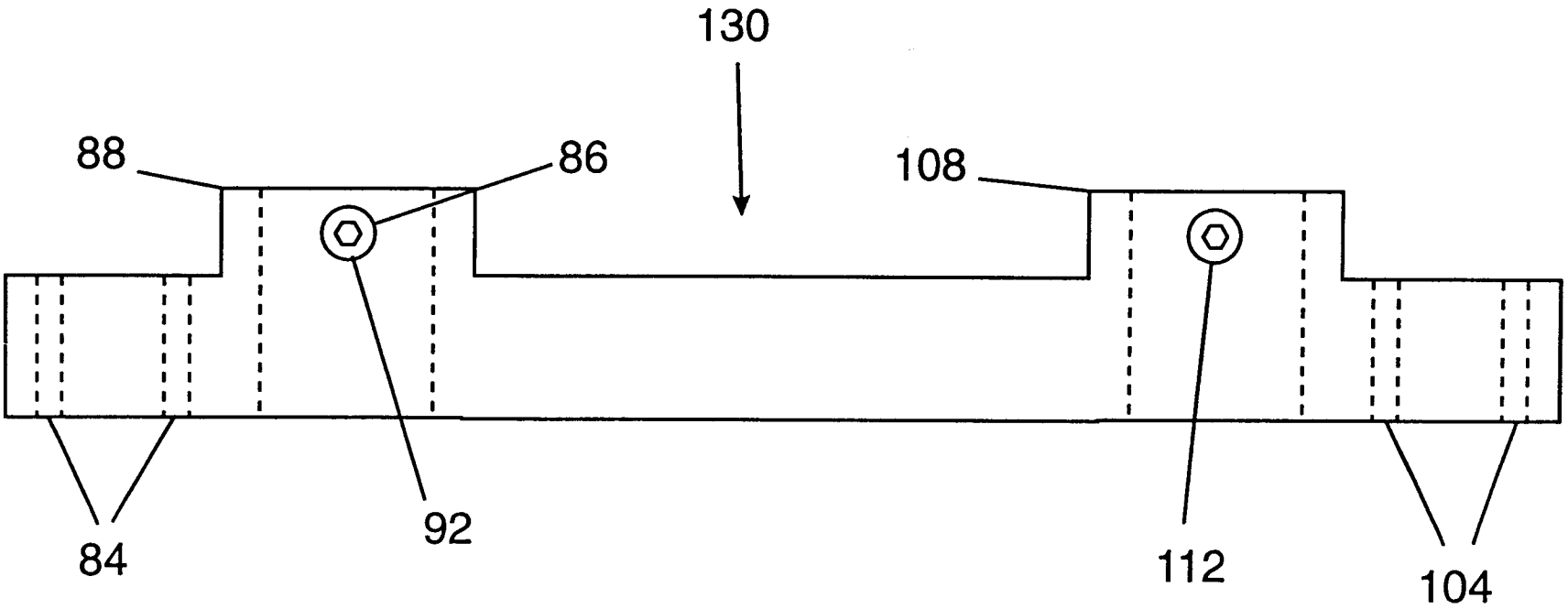
FIG. 8 discloses an alternate preferred embodiment of the rear and front bases wherein the key features of the two bases are provided by means of a single unified base.

FIG. 8 presents a view an alternate preferred embodiment of the rear and front bases 80 and 100 wherein the key features of the two bases are provided by means of a single unified base 130.

Figure 9:
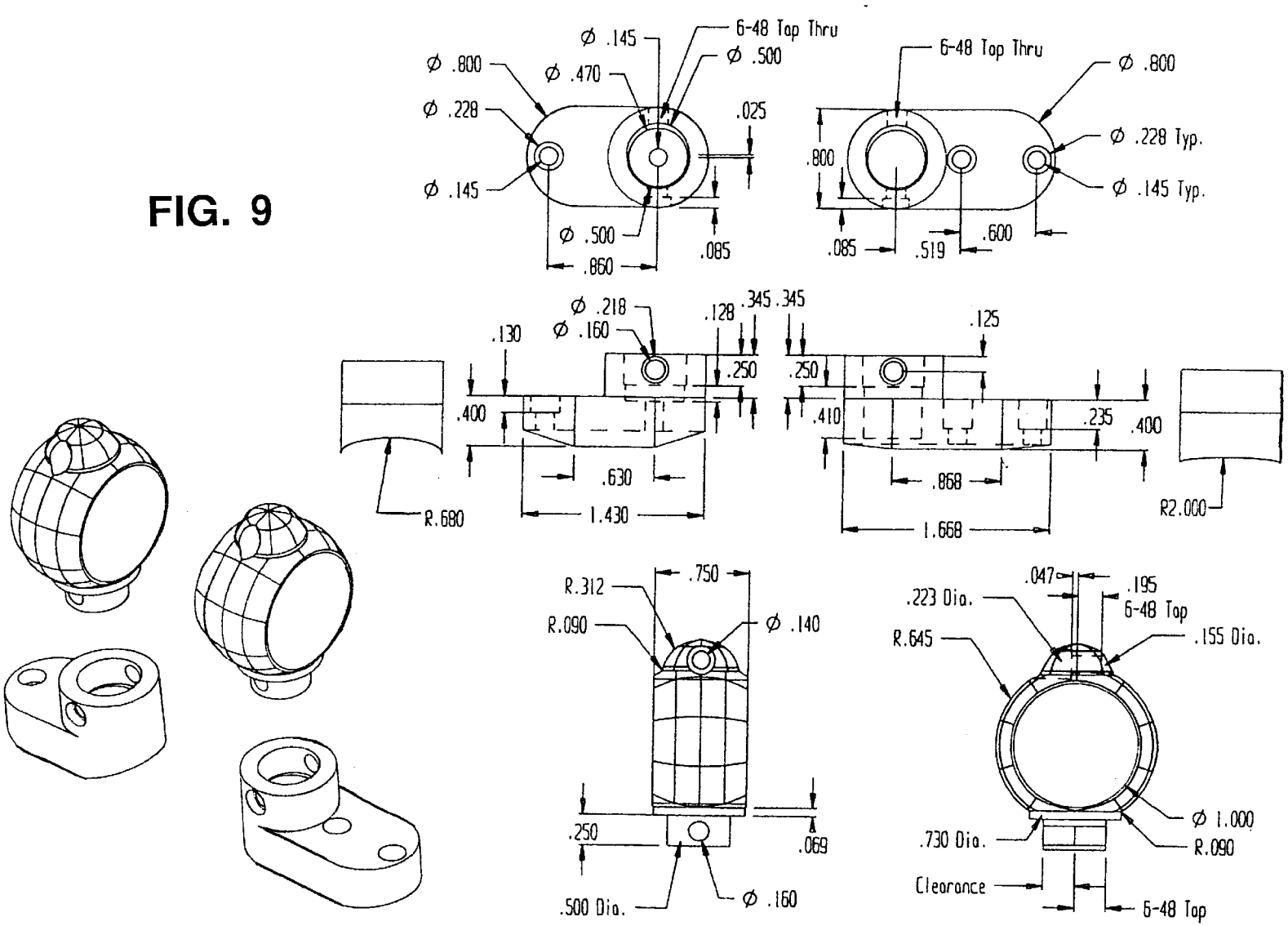
FIG. 9 is a CAD generated description of a preferred embodiment of the present invention.

FIG. 9 is a CAD generated description of a preferred embodiment of the present invention.

I claim:

1. A sight mount for mounting a sight to a weapon, said sight mount comprising:

a rear assembly ring having a first side and a second side, said first side having a first body, a first tongue, a first set screw hole within said first tongue, a first ledge, and a first top hole, said second side having a second body, a second tongue, a second tapped screw hole within said second tongue, a second ledge, and a second top hole, said rear assembly ring configured to be detachably secured to the sight by fitting said first body and said second body around the sight and securing said first side to said second side with a top screw placed through said first top hole and said second top hole;

a front assembly ring having a third side and a fourth side, said third side having a third body, a third tongue, a third set screw hole within said third tongue, a third ledge, and a third top hole, said fourth side having a fourth body, a fourth tongue, a fourth tapped screw hole within said fourth tongue, a fourth ledge, and a fourth top hole, said front assembly ring configured to be detachably secured to the sight by fitting said third body and said fourth body around the sight and securing said third side to said fourth side with a top screw placed through said third top hole and said fourth top hole;

a rear base configured to be detachably secured to the weapon, said rear base having a rear base body with a rear bushing, a rear shoulder atop said rear bushing, a through hole and a threaded set screw hole; said rear bushing configured to accept said first tongue and said second tongue of said rear assembly ring within said first ledge and said second ledge with said first ledge and said second ledge resting against said rear shoulder, said rear shoulder providing a support plane for said first ledge and said second ledge;

wherein said rear assembly ring is configured to be detachably secured to said rear base by inserting said first tongue and said second tongue of said rear assembly ring into said rear bushing with said first ledge and said second ledge resting against said rear shoulder, securing said second side of said rear assembly ring to said rear base with an attachment screw inserted through said through hole and threaded into said second tapped screw hole in said second side, and securing said first side of said rear assembly ring to said rear base with a set screw threaded through said threaded set screw hole and into said set screw hole of said first side; and a front base configured to be detachably secured to the weapon, said front base having a front base body with a front bushing, a front shoulder atop said front bushing, a through hole and a threaded set screw hole; said front bushing configured to accept said third tongue and said fourth tongue of said front assembly ring within said third ledge and said fourth ledge with said third ledge and said fourth ledge resting against said front shoulder, said front shoulder providing a support plane for said third ledge and said fourth ledge;

wherein said front assembly ring is configured to be detachably secured to said front base by inserting said third tongue and said fourth tongue of said front assembly ring into said front bushing with said third ledge and said fourth ledge resting against said front shoulder, securing said fourth side of said front assembly ring to said front base with an attachment screw inserted through said through hole and threaded into said fourth tapped screw hole in said fourth side, and securing said third side of said front assembly ring to said front base with a set screw threaded through said threaded set screw hole and into said set screw hole of said third side.

2. The sight mount of claim 1, wherein said threaded set screw hole of said rear base is located slightly off center from said set screw hole of said first side of said rear assembly ring.

3. The sight mount of claim 1, wherein said threaded set screw hole of said front base is located slightly off center from said set screw hole of said third side of said front assembly ring.

4. The sight mount of claim 1, wherein said rear base and said front base are joined together in a single unified piece.

5. The sight mount of claim 1, wherein said rear base and said front base are separate from one another.

6. The sight mount of claim 1, wherein said rear base includes a plurality of threaded holes for detachably securing said rear base to the weapon with a plurality of attachment screws.

7. The sight mount of claim 1, wherein said front base includes a plurality of threaded holes for detachably securing said front base to the weapon with a plurality of attachment screws.

* * * * *